US008936109B2

(12) United States Patent
Stowe, II et al.

(10) Patent No.: US 8,936,109 B2
(45) Date of Patent: Jan. 20, 2015

(54) CUTTING ELEMENTS FOR CUTTING TOOLS

(75) Inventors: Calvin J. Stowe, II, Bellaire, TX (US); Andrew D. Ponder, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 483 days.

(21) Appl. No.: 13/070,524

(22) Filed: Mar. 24, 2011

(65) Prior Publication Data

US 2011/0315448 A1 Dec. 29, 2011

Related U.S. Application Data

(63) Continuation-in-part of application No. 12/803,320, filed on Jun. 24, 2010, now Pat. No. 8,434,572.

(51) Int. Cl.

| | |
|---|---|
| ***B24D 99/00*** | (2010.01) |
| ***E21B 10/00*** | (2006.01) |
| ***E21B 10/54*** | (2006.01) |
| ***E21B 29/00*** | (2006.01) |

(52) U.S. Cl.

CPC ..... *B24D 99/005* (2013.01); *E21B 10/006* (2013.01); *E21B 10/54* (2013.01); *E21B 29/002* (2013.01)

USPC ..... 175/57; 175/428; 175/430

(58) Field of Classification Search

CPC ..... E21B 10/5673

USPC ..... 175/430, 428, 431, 401, 379, 385, 392, 175/57, 426; 407/113, 114; 76/108.2, 76/108.4; D15/138, 139

See application file for complete search history.

(56) References Cited

U.S. PATENT DOCUMENTS

| | | | | |
|---|---|---|---|---|
| 4,259,033 | A | 3/1981 | McCreery et al. | |
| 4,357,122 | A | 11/1982 | Hollis, Jr. et al. | |
| 4,449,864 | A * | 5/1984 | Haque et al. | 407/113 |
| 4,533,004 | A * | 8/1985 | Ecer | 175/430 |
| 4,538,690 | A * | 9/1985 | Short, Jr. | 175/430 |

(Continued)

FOREIGN PATENT DOCUMENTS

| | | | | |
|---|---|---|---|---|
| EP | 0234697 | A2 | 9/1987 | |
| EP | 0874127 | A2 | 10/1998 | |
| WO | WO 9739862 | A1 * | 10/1997 | B26B 13/06 |

OTHER PUBLICATIONS

Jim McNicol, et al., First true, CT underbalanced casing exit performed, World Oil, Mar. 2005, pp. 25-26, Gulf Publishing Company, USA.

(Continued)

*Primary Examiner* — David Andrews
*Assistant Examiner* — Ronald Runyan
(74) *Attorney, Agent, or Firm* — Steve Rosenblatt

(57) ABSTRACT

Cutting elements for downhole cutting tools comprise a top surface having a cutting surface portion and a cutting profile disposed across the top surface. The cutting elements comprise first and second longitudinal side surfaces and first and second lateral side surfaces, each having a respective cross-section. The cutting profile can be disposed on the cutting surface either asymmetrically or symmetrically. Asymmetrical disposition permits two cutting elements to be arranged facing each other to cover a center point of a cutting tool. The cutting edge of asymmetrical or symmetrically disposed cutting profiles can have a shape that facilitates self-sharpening during cutting.

21 Claims, 12 Drawing Sheets

(56) References Cited

U.S. PATENT DOCUMENTS

| | | | | |
|---|---|---|---|---|
| 4,577,706 | A | 3/1986 | Barr | |
| 4,593,777 | A | 6/1986 | Barr | |
| 4,717,290 | A | 1/1988 | Reynolds et al. | |
| 4,780,274 | A | 10/1988 | Barr | |
| 4,796,709 | A | 1/1989 | Lynde et al. | |
| 4,934,878 | A | 6/1990 | Plutschuck et al. | |
| 4,978,260 | A | 12/1990 | Lynde et al. | |
| 4,984,488 | A | 1/1991 | Lunde et al. | |
| 5,025,873 | A | 6/1991 | Cerkovnik | |
| 5,027,914 | A | 7/1991 | Wilson | |
| 5,058,666 | A | 10/1991 | Lynde et al. | |
| 5,150,755 | A | 9/1992 | Cassel et al. | |
| 5,186,268 | A | 2/1993 | Clegg | |
| 5,238,074 | A | 8/1993 | Tibbitts et al. | |
| 5,244,039 | A | 9/1993 | Newton et al. | |
| 5,297,630 | A | 3/1994 | Lynde et al. | |
| 5,301,762 | A | 4/1994 | Besson | |
| 5,373,900 | A | 12/1994 | Lynde et al. | |
| 5,443,335 | A | 8/1995 | Shimano et al. | |
| 5,443,565 | A | 8/1995 | Strange, Jr. | |
| 5,456,312 | A | 10/1995 | Lynde et al. | |
| 5,460,233 | A | 10/1995 | Meany et al. | |
| 5,685,671 | A | 11/1997 | Packer et al. | |
| 5,769,554 | A * | 6/1998 | Slocum | 403/13 |
| 5,778,995 | A | 7/1998 | McGarian | |
| 5,810,079 | A | 9/1998 | Lynde et al. | |
| 5,899,268 | A | 5/1999 | Lynde et al. | |
| 5,979,577 | A | 11/1999 | Fielder | |
| 6,106,585 | A | 8/2000 | Packer et al. | |
| 6,155,343 | A | 12/2000 | Nazzal et al. | |
| 6,167,958 | B1 | 1/2001 | Lynde | |
| 6,202,770 | B1 * | 3/2001 | Jurewicz et al. | 175/428 |
| 6,308,790 | B1 | 10/2001 | Mensa-Wilmot et al. | |
| 6,422,328 | B1 | 7/2002 | Holland et al. | |
| 6,464,434 | B2 | 10/2002 | Lynde | |
| 6,615,934 | B2 | 9/2003 | Mensa-Wilmot | |
| 7,096,982 | B2 | 8/2006 | McKay et al. | |
| 7,363,992 | B2 | 4/2008 | Stowe et al. | |
| 7,513,319 | B2 | 4/2009 | DeVall | |
| 2003/0034180 | A1 | 2/2003 | Mensa-Wilmot | |
| 2005/0039905 | A1 | 2/2005 | Hart et al. | |
| 2005/0109546 | A1 | 5/2005 | Stowe et al. | |
| 2005/0150656 | A1 | 7/2005 | Stowe | |
| 2005/0269139 | A1 | 12/2005 | Shen et al. | |
| 2006/0090897 | A1 | 5/2006 | Stowe et al. | |
| 2007/0023188 | A1 | 2/2007 | Roberts et al. | |
| 2007/0201962 | A1 | 8/2007 | Limell et al. | |
| 2008/0006446 | A1 * | 1/2008 | Stowe et al. | 175/263 |
| 2008/0149393 | A1 | 6/2008 | McClain et al. | |
| 2008/0296070 | A1 | 12/2008 | Shen et al. | |
| 2008/0302578 | A1 | 12/2008 | Eyre et al. | |
| 2008/0308276 | A1 | 12/2008 | Scott | |
| 2009/0266619 | A1 | 10/2009 | Durairajan et al. | |
| 2010/0012387 | A1 | 1/2010 | Huynh et al. | |
| 2010/0025121 | A1 | 2/2010 | Schwefe | |
| 2010/0084198 | A1 | 4/2010 | Durairajan et al. | |
| 2010/0108402 | A1 | 5/2010 | Ponder et al. | |
| 2011/0192653 | A1 | 8/2011 | Stowe, II | |
| 2011/0203856 | A1 | 8/2011 | Lynde | |
| 2011/0315447 | A1 | 12/2011 | Stowe, II | |
| 2011/0315455 | A1 | 12/2011 | Stowe, II | |

OTHER PUBLICATIONS

Notification of Transmittal of the International Search Report and the Written Opinion of the International Searching Authority, or the Declaration, Dec. 7, 2011, pp. 1-2, PCT/US2011/039962, Korean Intellectual Property Office.

International Search Report, Dec. 7, 2011, pp. 1-5, PCT/US2011/039962, Korean Intellectual Property Office.

Written Opinion of the International Searching Authority, Dec. 7, 2011, pp. 1-3, PCT/US2011/039962, Korean Intellectual Property Office.

Notification of Transmittal of the International Search Report and the Written Opinion of the International Searching Authority, or the Declaration, Dec. 7, 2011, pp. 1-2, PCT/US2011/039971, Korean Intellectual Property Office.

International Search Report, Dec. 7, 2011, pp. 1-3, PCT/US2011/039971, Korean Intellectual Property Office.

Written Opinion of the International Searching Authority, Dec. 7, 2011, pp. 1-3, PCT/US2011/039971, Korean Intellectual Property Office.

Notification of Transmittal of the International Search Report and the Written Opinion of the International Searching Authority, or the Declaration, Dec. 7, 2011, pp. 1-2, PCT/US2011/039977, Korean Intellectual Property Office.

International Search Report, Dec. 7, 2011, pp. 1-3, PCT/US2011/039977, Korean Intellectual Property Office.

Written Opinion of the International Searching Authority, Dec. 7, 2011, pp. 1-4, PCT/US2011/039977, Korean Intellectual Property Office.

Office Action dated May 24, 2012, in U.S. Appl. No. 12/803,320, U.S. Patent and Trademark Office, U.S.A.

* cited by examiner

CUTTING ELEMENTS FOR CUTTING TOOLS

RELATED APPLICATION

This application is a continuation in part application of, and claims priority to, U.S. patent application Ser. No. 12/803,320 filed Jun. 24, 2010 now U.S. Pat. No. 8,434,572, currently pending.

BACKGROUND

1. Field of Invention

The invention is directed to cutting elements or "cutters" for cutting tools and, in particular, to cutting elements that comprise a cutting profile disposed across a top surface of the cutting element wherein the cutting profile self-sharpens during cutting of objects, including objects such as stuck tools, bridge plugs, well tubing, well casing, and the like disposed within an oil or gas well and/or wherein the cutting elements can be disposed on a cutting tool so that the portion of the object disposed below the center point of the cutting tool can be cut.

2. Description of Art

In the drilling, completion, and workover of oil and gas wells, it is common to perform work downhole in the wellbore with a tool that has some sort of cutting profile interfacing with a downhole structure. Examples would be milling a downhole metal object with a milling tool or cutting through a tubular with a cutting or milling tool. To facilitate these operations, cutting elements are disposed on the downhole cutting tool; however, the shape, size, and design of the cutting elements can limit the locations in which the cutting elements can be placed. For example, the shape, size, and design of the cutting elements limit the ability of the tool to provide effective cutting of the object disposed below the center point of the tool. In addition, or alternatively, the cutting edge of the cutting elements can become dull during use.

SUMMARY OF INVENTION

Broadly, the invention is directed to cutting elements disposed on downhole cutting tools utilized in cutting away objects, such as those disposed within a well. The term "object" encompasses any physical structure that may be desired to be cut such as those disposed within a well, for example, another tool that is stuck within the well, a bridge plug, the well tubing, the well casing, or the like.

In one particular embodiment, the cutting elements are disposed on blades of a downhole cutting tools that are disposed on a face of the tool. The blades are disposed on the face such that rotation of the tool causes rotation of the blades. One or more of the blades include a front side surface that has disposed on it one or more cutting elements, and a back side surface. The back side surface generally does not include any cutting elements. The presence of the cutting element on the blade allows the blade to cut objects during rotation. In addition, the presence of the cutting element along a beveled portion of the blade allows the positioning of the cutting elements such that the center point of the face of the downhole cutting tool is covered by a cutting element. In this arrangement, rotation of the downhole cutting tool provides for the portion of the object disposed directly below the center point of the face of the downhole cutting tool to be cut away.

In one specific embodiment, the cutting elements comprise a top surface having an cutting profile disposed thereon in either an asymmetrical arrangement or a symmetrical arrangement. The cutting profile includes a cutting edge that is shaped such that the cutting edge is self-sharpened by the object during cutting of the object. In other specific embodiments, the cutting elements comprise various shapes and designs to facilitate placement of the cutting elements on the face or other structure carrying the cutting elements on the cutting end of the downhole cutting tool and to facilitate cutting the object, such as those disposed in the wellbore. For example, the cutting elements can be arranged so that they cover the center point of a blade mill.

While the invention will be described in connection with the preferred embodiments, it will be understood that it is not intended to limit the invention to these embodiments. On the contrary, it is intended to cover all alternatives, modifications, and equivalents, as may be included within the spirit and scope of the invention as defined by the appended claims.

DETAILED DESCRIPTION OF INVENTION

Figure 1:
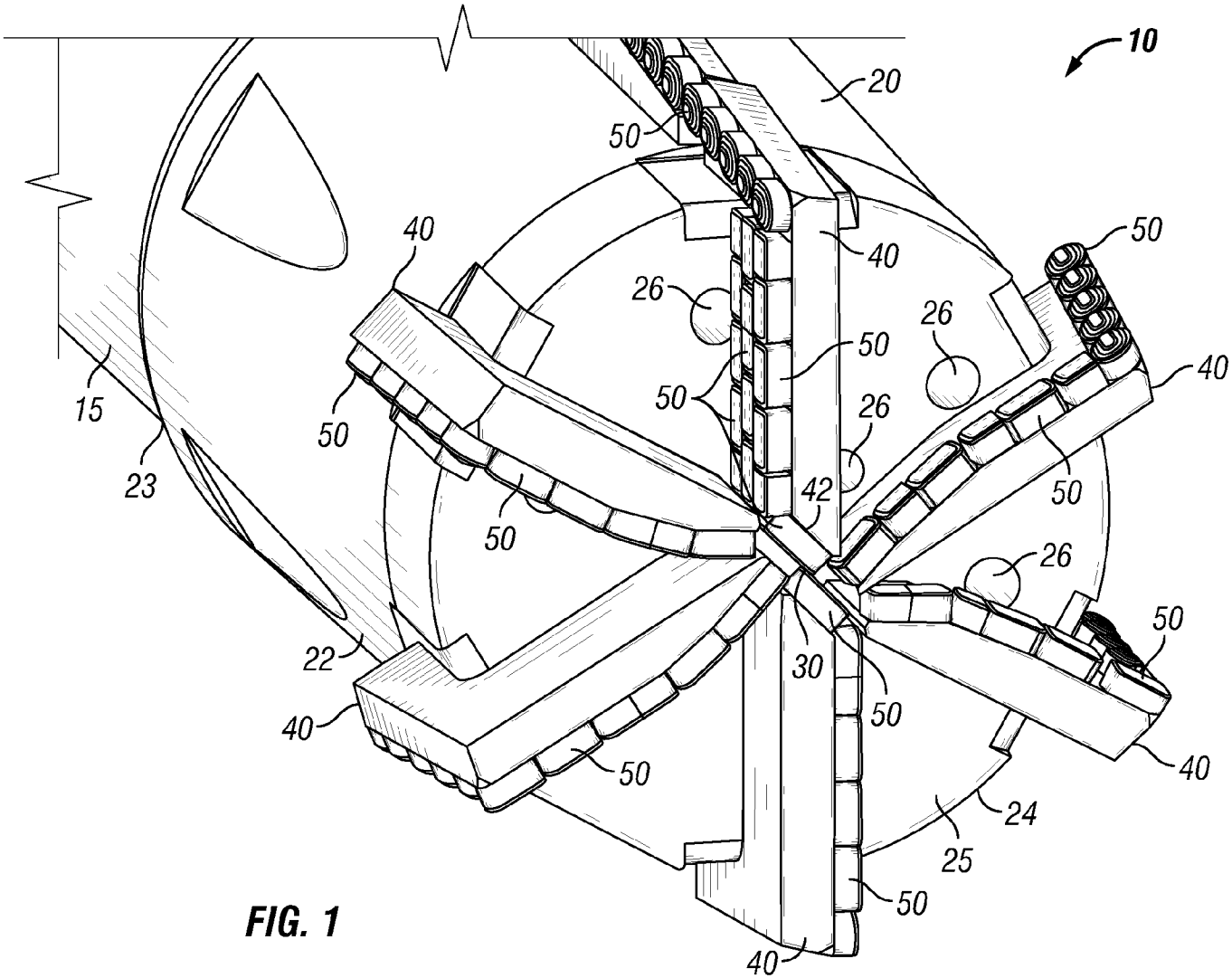
FIG. 1 is a perspective view of one specific embodiment of a downhole cutting tool having cutting elements such as those disclosed herein.
Figure 2:
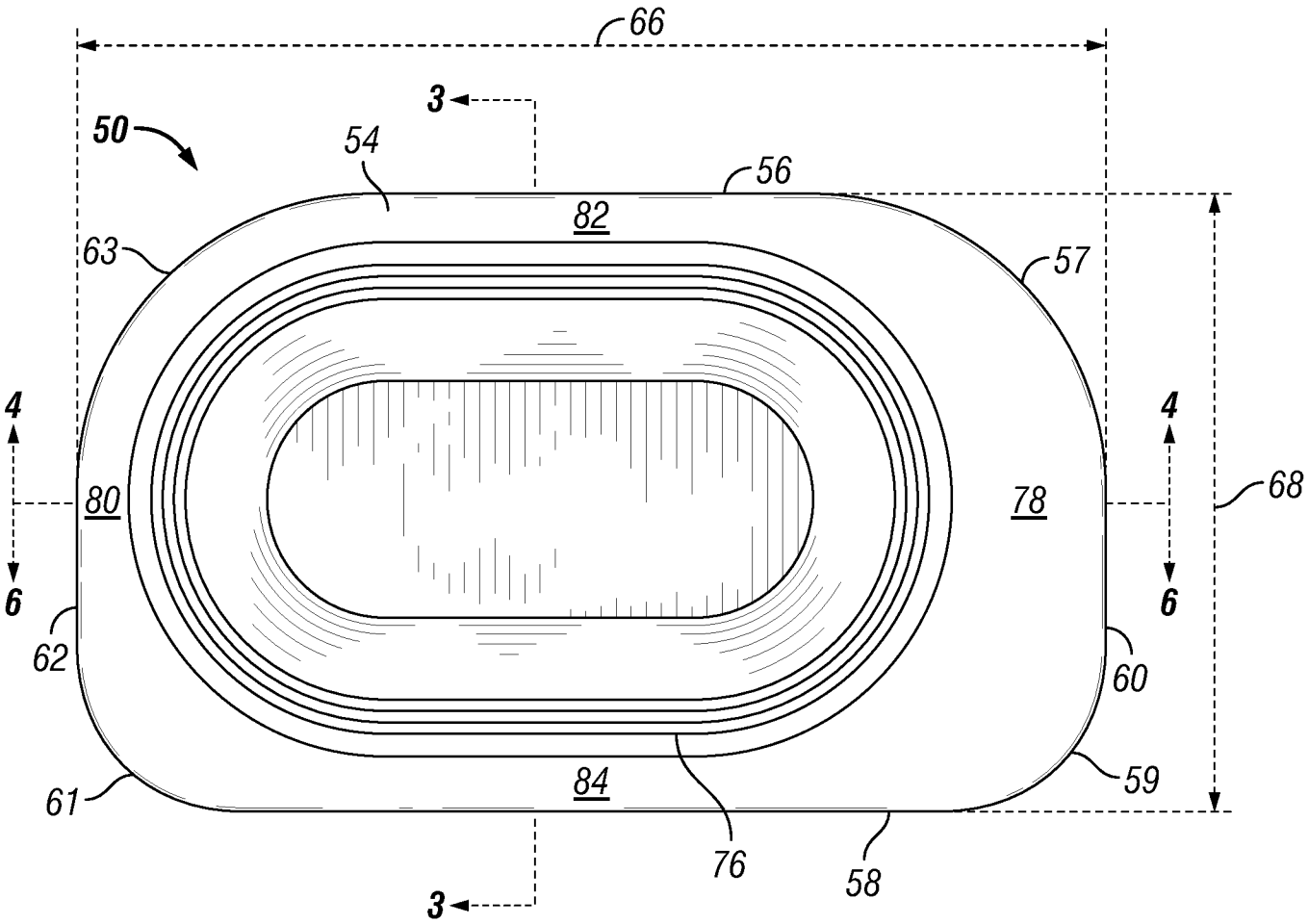
FIG. 2 is a top view of one specific embodiment of a cutting element disclosed herein.

Referring now to FIG. 1, downhole cutting tool 10 comprises blade mill 20 having body or housing 22 adapted at upper end 23 to be connected to drill or work string 15, cutting end 24 having face 25, drilling fluid ports 26 through which drilling or cutting fluid flows to facilitate cutting by blade mill 20, and, as shown in the specific embodiment in the Figures, six blades 40. Affixed to a front or forward face of each of the six blades 40 are one or more cutting elements 50. In addition, as shown in FIG. 1, two cutting elements 50 are disposed on beveled portions 42 of blades 40 facing toward each other across center point 30 of face 25 so that the portion of the object below center point 30 can be cut by cutting elements 50. And, as further shown in FIG. 1, these two cutting elements 50 disposed on beveled portions 42 overlap one another to facilitate cutting the portion of the object below the center point This overlapping increases the strength and durability of these two cutting elements 50 and decreases the probability that any uncut portion of the object remains that could be forced between the two cutting elements 50 causing the two cutting elements 50 to wedge apart and possibly break. It is to be understood that although the cutting elements 50 are shown in FIG. 1 as having various shapes, sizes, and designs, any one of the cutting elements 50 may have one or more of the features discussed below.

Figure 3:
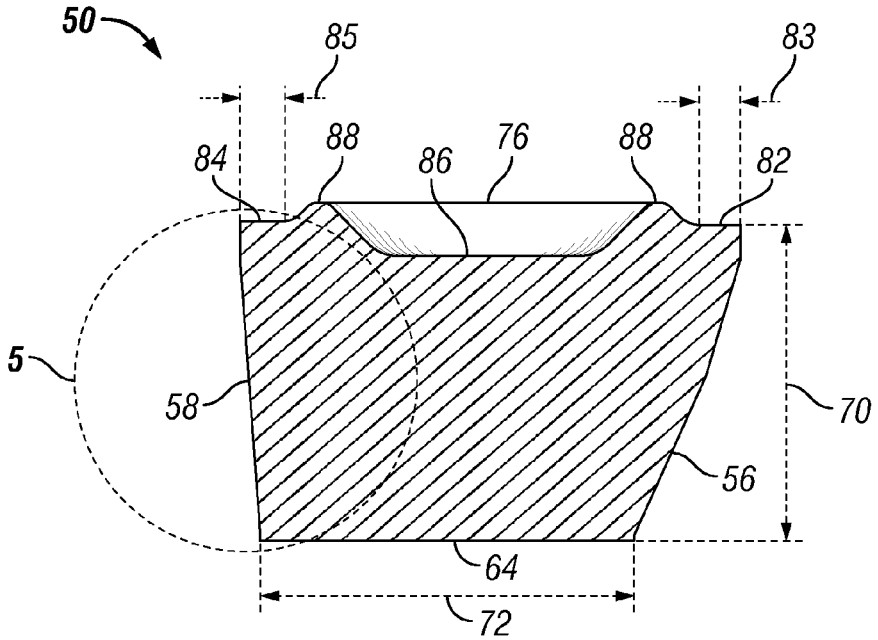
FIG. 3 is a cross-sectional view of the cutting element of FIG. 2 taken along line 3-3.

Referring now to FIGS. 2-12, cutting element 50 comprises top surface or cutting face 54, first longitudinal side surface 56, second longitudinal side surface 58, first lateral side surface 60, second lateral side surface 62, and bottom surface 64 (FIG. 3). First and second lateral side surfaces 60, 62 define top surface length 66 (shown in FIG. 2), i.e., the length of cutting element 50 along top surface 54 between first and second lateral side surfaces 60, 62. Length 66 can be any distance/measurement desired or necessary to facilitate placement of cutting element 50 on cutting end 24 of a downhole cutting tool. For example, length 66 can be in the range from 0.250 inches to 1.0 inch. In one specific embodiment, length 66 is 0.625 inches.

First and second lateral side surfaces 60, 62 also define bottom surface length 74 (shown in FIG. 4), i.e., the length of cutting element 50 along bottom surface 64 between first and second lateral side surfaces 60, 62. Length 74 can be any distance/measurement desired or necessary to facilitate placement of cutting element 50 on cutting end 24 of a downhole cutting tool. For example, length 74 can be in the range from 0.250 inches to 1.0 inch. In one specific embodiment, length 74 is 0.473 inches.

First and second longitudinal side surfaces 56, 58 define top surface width 68 (shown in FIG. 2), i.e., the width of cutting element 50 along top surface 54 between first and second longitudinal side surfaces 56, 58. Width 68 can be any distance/measurement desired or necessary to facilitate placement of cutting element 50 on cutting end 24 of a downhole cutting tool. For example, width 68 can be can be in the range from 0.250 inches to 1.0 inch. In one specific embodiment, width 68 is 0.375 inches.

First and second longitudinal side surfaces 56, 58 define bottom surface width 72 (shown in FIG. 3), i.e., the width of cutting element 50 along bottom surface 64 between first and second longitudinal side surfaces 56, 58. Width 72 can be any distance/measurement desired or necessary to facilitate placement of cutting element 50 on cutting end 24 of a downhole cutting tool. For example, width 72 can be can be in the range from 0.250 inches to 1.0 inch. In one specific embodiment, width 72 is 0.281 inches.

Top surface 54 and bottom surface 64 define height 70 (shown in FIG. 3). Height 70 can be any distance/measurement desired or necessary to facilitate placement of cutting element 50 on cutting end 24 of a downhole cutting tool. For example, height 70 can be can be in the range from 0.100 inches to 1.0 inch. In one specific embodiment, height 70 is 0.250 inches.

As shown in the embodiment of the Figures, cutting element 50 comprises first radial surface 57 disposed between first longitudinal side surface 56 and first lateral side surface 60, second radial surface 59 disposed between first lateral side surface 60 and second longitudinal side surface 58, third radial surface 61 disposed between second longitudinal side surface 58 and first lateral side surface 60, and fourth radial surface 63 disposed between second lateral side surface 62 and first longitudinal side surface 56. Each of radial surfaces 57, 59, 61, 63 comprise a radius of curvature. Each of the radii of curvature of radial surfaces 57, 59, 61, 63 can be any distance/measurement desired or necessary to facilitate placement of cutting element 50 on cutting end 24 of a downhole cutting tool. For example, the radii of curvature of radial surfaces 57, 59, 61, 63 can be in the range from 0.010 inches to 1.0 inch. In the particular embodiment of FIGS. 2-8, the radius of curvature of radial surface 57 is equal to the radius of curvature of radial surface 63, the radius of curvature of radial surface 59 is equal to the radius of curvature of radial surface 61, and the radii of curvature of radial surfaces 57, 63 are not equal to the radii of curvature of radial surfaces 59, 61. In one specific embodiment, the radius of curvature of radial surface 57 is 0.188 inches, radius of curvature of radial surface 59 is 0.090 inches, radius of curvature of radial surface 61 is 0.090 inches, and radius of curvature of radial surface 63 is 0.188 inches.

Figure 4:
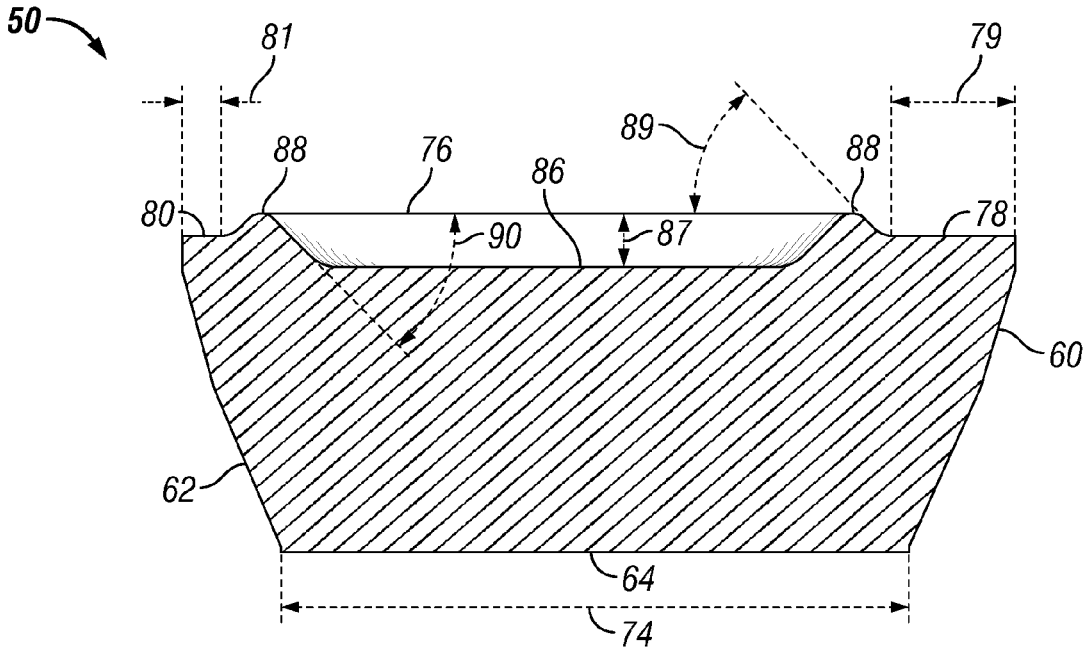
FIG. 4 is a cross-sectional view of the cutting element of FIG. 2 taken along line 4-4.

As best illustrated in FIGS. 3-4, cutting profile 76 comprises recess 86 and cutting edge 88 which define depth 87 (shown in FIG. 4) of cutting profile 76. Depth 87 can be any distance/measurement desired or necessary to facilitate cutting an object (not shown) disposed in a wellbore. For example, depth 87 can be can be in the range from 0.010 inches to about 60% of height 70. In one specific embodiment, depth 87 is 0.040 inches.

Cutting edge 88 is shown as having an oval shape, however, it is to be understood that cutting edge 88 can have any shape desired or necessary to facilitate cutting an object (not shown) disposed in a wellbore, e.g., rectangular, square, circular, egg-shaped, and the like. As shown in the Figures, cutting edge 88 is defined by two angles 89, 90. Angles 89, 90 can be set at any degree desired or necessary to facilitate cutting the object to facilitate cutting edge 88 to self-sharpen as it cuts. For example, angles 89, 90 can be in the range from 15 degrees to 75 degrees. In one specific embodiment, angles 89, 90 are 45 degrees.

Cutting profile 76 is disposed on top surface or cutting face 54 of cutting element 50. Cutting profile 76 may be disposed symmetrically or asymmetrically along top surface 54. As used herein, the term "asymmetrically" means cutting profile 76 is not centered on top surface 54. In the embodiment of FIGS. 1-12, cutting profile 76 is disposed asymmetrically on top surface 54. Thus, one or more portions or areas of top surface 54 disposed around the outside or circumference of cutting profile 76 is not equal to any other such portions. These portions are referred to herein as "cutting surface portions" of top surface or cutting face 54. The cutting surface portion(s) facilitate the overlapping of two cutting elements 50 such as shown in FIG. 1 (discussed above) and FIGS. 9-12 (discussed in greater detail below).

As shown in FIGS. 2-8, this embodiment of cutting element 50 comprises numerous cutting surface portions, four of which are defined by the longitudinal and lateral edges of cutting edge 88 and first and second longitudinal side surfaces 56, 58 and first and second lateral side surfaces 60, 62. Cutting surface portion 78 is defined by first lateral side surface 60 and a first lateral edge of cutting edge 88. Cutting surface portion 80 is defined by second lateral side surface 62 and a second lateral edge of cutting edge 88. As used herein, "lateral edge" means the portion of cutting edge 88 that is closest to first lateral side surface 60 or second lateral side surface 62.

Cutting surface portion 82 is defined by first longitudinal side surface 56 and a first longitudinal edge of cutting edge 88. Cutting surface portion 84 is defined by second longitudinal side surface 58 and a second longitudinal edge of cutting edge 88. As used herein, "longitudinal edge" means the portion of cutting edge 88 that is closest to first longitudinal side surface 56 or second longitudinal side surface 58.

Each of cutting surface portions 78, 80, 82, 84 comprise a distance/measurement. Distance 79 (FIG. 4) is defined as the measurement from cutting edge 88 to first lateral side surface 60. Distance 81 (FIG. 4) is defined as the measurement from cutting edge 88 to second lateral side surface 62. Distance 83 (FIG. 3) is defined as the measurement from cutting edge 88 to first longitudinal side surface 56. Distance 85 (FIG. 3) is defined as the measurement from cutting edge 88 to second longitudinal side surface 58. As shown in the drawings, distance 79 is greater than distances 81, 83, and 85 so that cutting surface portion 78 has a larger area compared to cutting surface portions 80, 82, and 84. However, it is to be understood, that distances 79, 81, 83, and 85 can be modified in any way desired or necessary to facilitate cutting of the object in the wellbore and to facilitate cutting edge 88 to self-sharpen during cutting. For example, distance 79 can be in the range from 0.010 inches to 0.120 inches, distance 81 can be in the range from 0.010 inches to 0.120 inches, distance 83 can be in the range from 0.010 inches to 0.120 inches, and distance 85 can be in the range from 0.010 inches to 0.120 inches. In one particular embodiment, distance 79 is at least twice as long as distance 81. In another embodiment, distance 79 is 0.102 inches, distance 81 is 0.040 inches, distance 83 is 0.040 inches, and distance 85 is 0.040 inches.

Figure 5:
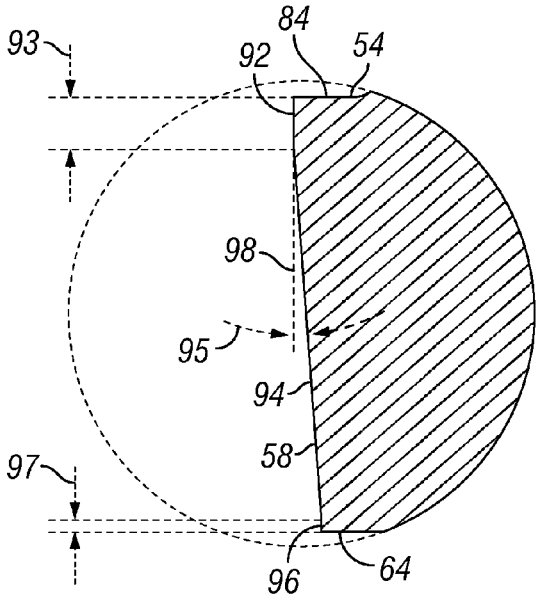
FIG. 5 is an enlarged cross-sectional view of the portion of the cutting element encircled along line 5 in FIG. 3.

As illustrated in FIG. 5, a cross-section view of second longitudinal side surface 58 shows that second longitudinal side surface 58 comprises bevel portion 94 disposed at angle 95 relative to axis 98. Axis 98 is disposed perpendicular to top surface 54. Angle 95 can be in the range from 3 degrees to 12 degrees. In a specific embodiment angle 95 is 5 degrees.

In addition, cross-section view of second longitudinal side surface 58 shows that second longitudinal side surface 58 includes upper portion 92 that is parallel to axis 98 and lower portion 96 that is parallel to axis 98. Length 93 of upper portion 92 can be any distance/measurement desired or necessary to facilitate placement of cutting element 50 on cutting end 24 of a downhole cutting tool. For example, length 93 can be in the range from 0.010 inches to 0.035 inches. In a specific embodiment, length 93 of upper portion 92 is 0.025 inches.

Length 97 of lower portion 96 can be any distance/measurement desired or necessary to facilitate placement of cutting element 50 on cutting end 24 of a downhole cutting tool. For example, length 97 can be in the range from 0.001 inches to 0.010 inches. In a specific embodiment, length 97 of lower portion 96 is 0.005 inches.

Figure 6:
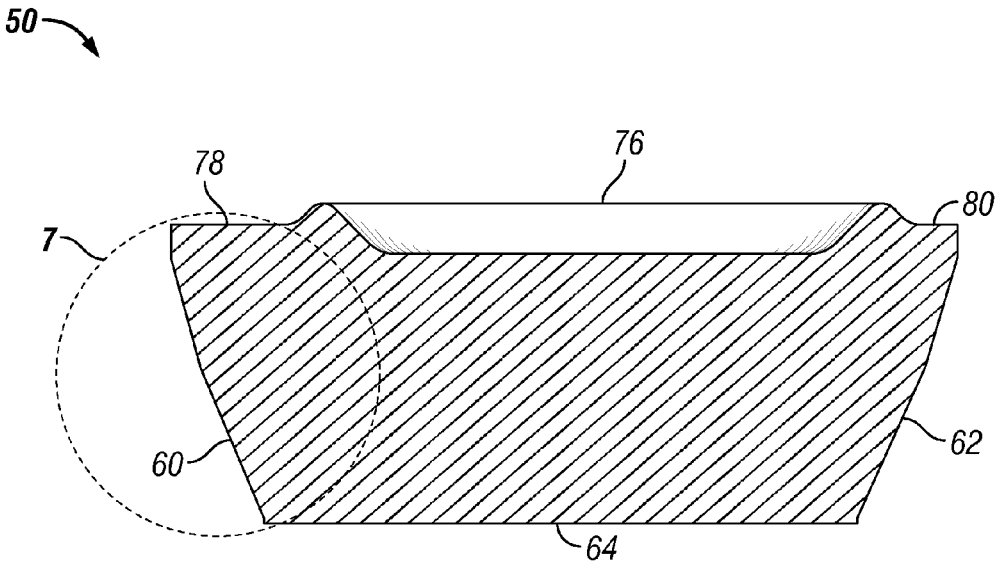
FIG. 6 is a cross-sectional view of the embodiment of the cutting element of FIG. 2 taken along line 6-6.
Figure 7:
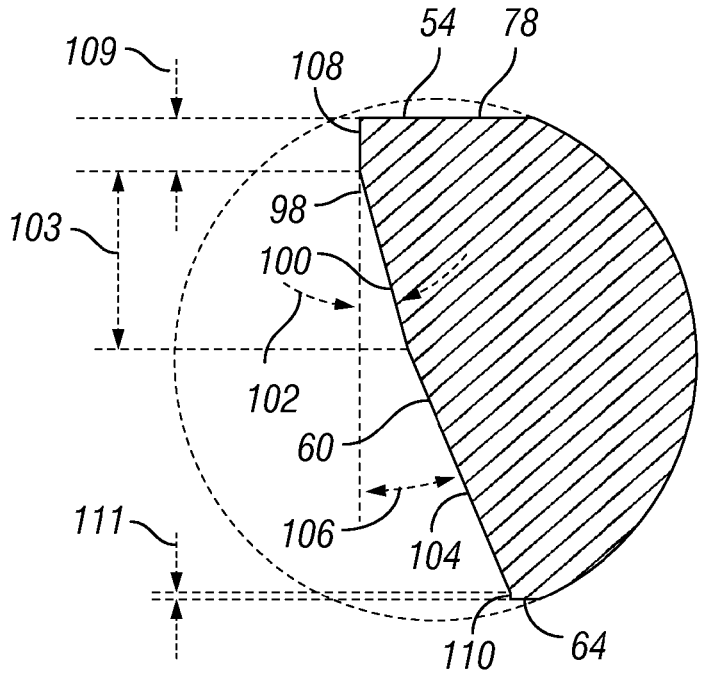
FIG. 7 is an enlarged cross-sectional view of the portion of the cutting element encircled along line 7 in FIG. 6.
Figure 8:
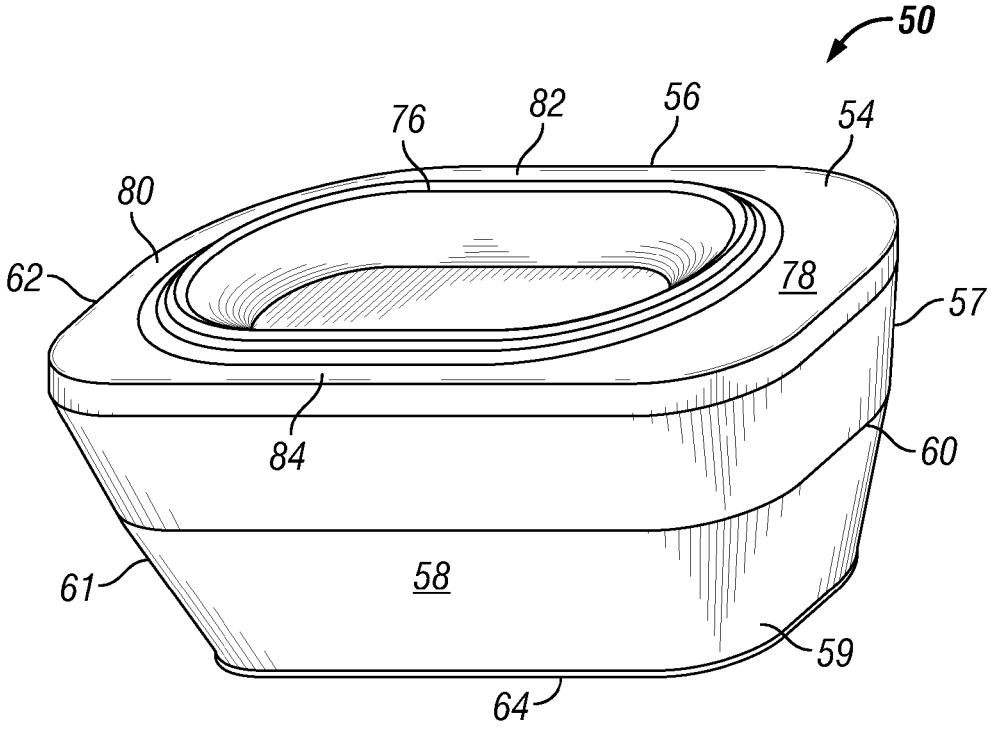
FIG. 8 is a perspective view of the embodiment of the cutting element of FIGS. 2-7.

As shown in FIGS. 6-7, first lateral side surface 60 comprises upper beveled portion 100 disposed at angle 102 relative to axis 98, and lower beveled portion 104 disposed at angle 106 relative to axis 98. In the embodiment shown in the Figures, upper beveled portion 100 is disposed adjacent to lower beveled portion 104.

Length 103 of upper beveled portion 100 can be any distance/measurement desired or necessary to facilitate placement of cutting element 50 on cutting end 24 of a downhole cutting tool. For example, length 103 can be can be in the range from 0.025 inches to 1.0 inch. In a particular embodiment, length 103 is 0.085 inches.

Angles 102, 106 can be any angle desired or necessary to facilitate placement of cutting element 50 on cutting end 24 of a downhole cutting tool. For example, angle 102 can be in the range from 10 degrees to 20 degrees and angle 106 can be in the range from 20 degrees to 30 degrees. In a specific embodiment angle 102 is 15 degrees and angle 106 is 24 degrees.

In addition, cross-section view of first lateral side surface 60 shows that first lateral side surface 60 includes upper portion 108 that is parallel to axis 98 and lower portion 110 that is parallel to axis 98. Length 109 of upper portion 108 can be any distance/measurement desired or necessary to facilitate placement of cutting element 50 on cutting end 24 of a downhole cutting tool. For example, length 109 can be in the range from 0.010 inches to 0.035 inches. In a specific embodiment, length 109 of upper portion 108 is 0.025 inches.

Length 111 of lower portion 110 can be any distance/measurement desired or necessary to facilitate placement of cutting element 50 on cutting end 24 of a downhole cutting tool. For example, length 111 can be in the range from 0.001 inches to 0.010 inches. In a specific embodiment, length 111 of lower portion 110 is 0.005 inches.

Although not shown in detail, it is to be understood that in the embodiment shown in FIGS. 2-12, the cross-section of second lateral side surface 62 is the same as the cross-section of first lateral side surface 60. In other words, the cross-section of second lateral side surface 62 has the same beveled portions, parallel portions, and angles as first lateral side surface 60. It is also to be understood that these cross-sections are not required to be identical.

Further, it is to be understood that the cross-section of first longitudinal side surface 56 can include beveled portions, parallel portions, and angles. In the specific embodiment shown in the Figures, first longitudinal side surface 56 includes beveled portions, parallel portions, and angles that coincide with, and are identical to, beveled portions, 100, 104, parallel portions 108, 110, and angles 102, 106 of first and second lateral side surfaces 60, 62. It is also to be understood that the cross-section of first longitudinal side surface 56 is not required to be identical to the cross-sections of either first or second lateral side surfaces 60, 62.

In one particular embodiment of the cutting element of FIGS. 2-8, length 66 is 0.625 inches, width 68 is 0.375 inches, length 74 is 0.473 inches, width 72 is 0.281 inches, height 70 is 0.250 inches, radii of curvature 57, 63 are each 0.188 inches, radii of curvature 59, 61 are each 0.090 inches, length 93 of upper portion 92 is 0.025 inches, bevel angle 95 is 5 degrees, length 97 of lower portion 96 is 0.005 inches, length 109 of upper portion 108 is 0.025 inches, bevel angle 102 is 15 degrees, length 103 of bevel portion 100 is 0.085 inches, bevel angle 106 is 24 degrees, length 111 of lower portion 110 is 0.005 inches, depth 87 is 0.040 inches, and angles 89, 90 are 45 degrees.

Figure 9:
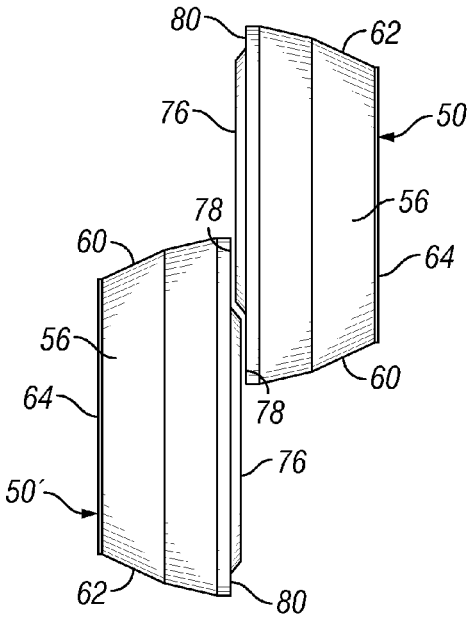
FIG. 9 is a side view of two cutting elements of FIGS. 2-7 shown disposed parallel and facing each other.
Figure 10:
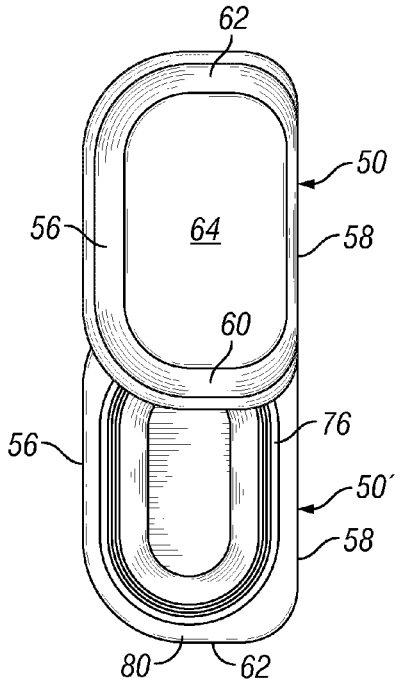
FIG. 10 is a rotated view of the two cutting elements of FIG. 9 shown disposed parallel and facing each other.

Referring with particular reference to FIGS. 9-10, but as also illustrated in FIG. 1, two cutting elements 50, 50' are shown in relation to one another as they can be arranged on cutting end 24 of downhole cutting tool 20, such as on two blades 40 as shown in FIG. 1 or directly on a continuous face, such as face 25 of cutting end 24. As illustrated, the top surfaces or cutting faces 54 of the two cutting elements 50, 50' are disposed facing each other with cutting surface portion 78 of cutting element 50 being disposed opposite cutting profile 76 of cutting element 50', and cutting surface portion 78 of cutting element 50' being disposed opposite cutting profile 76 of cutting element 50. As shown in FIGS. 9-10, cutting elements 50, 50' are disposed parallel to each other with second longitudinal side surfaces 58 of cutting elements 50, 50' aligned with each other, and first longitudinal side surfaces 56 of cutting elements 50, 50' aligned with each other.

Figure 11:
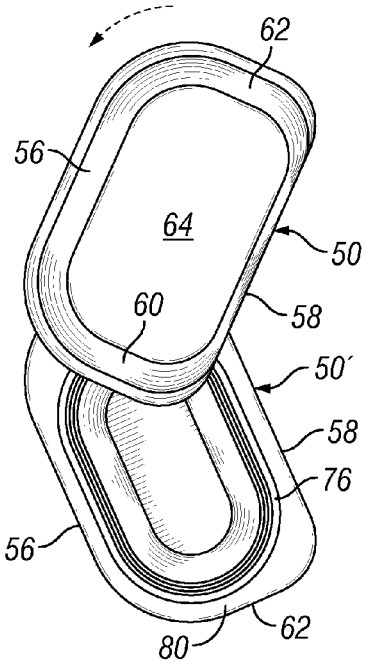
FIG. 11 is a view of the embodiment of the cutting elements of FIGS. 2-7 shown disposed facing each other at a non-parallel angle.
Figure 12:
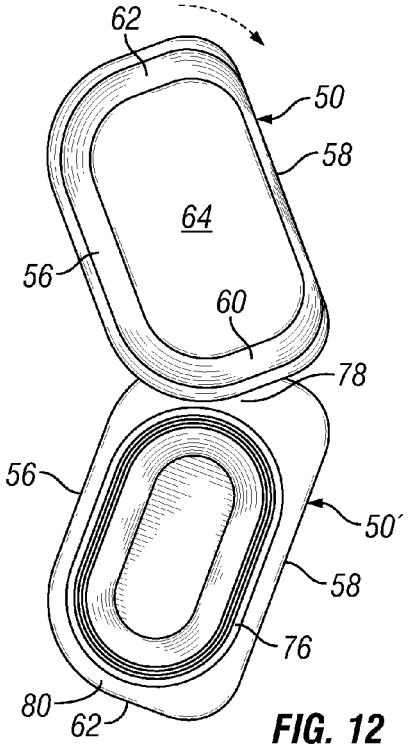
FIG. 12 is a view of the embodiment of the cutting elements of FIGS. 2-7 shown disposed facing each other at a non-parallel angle different from the non-parallel angle in FIG. 11.
Figure 13:
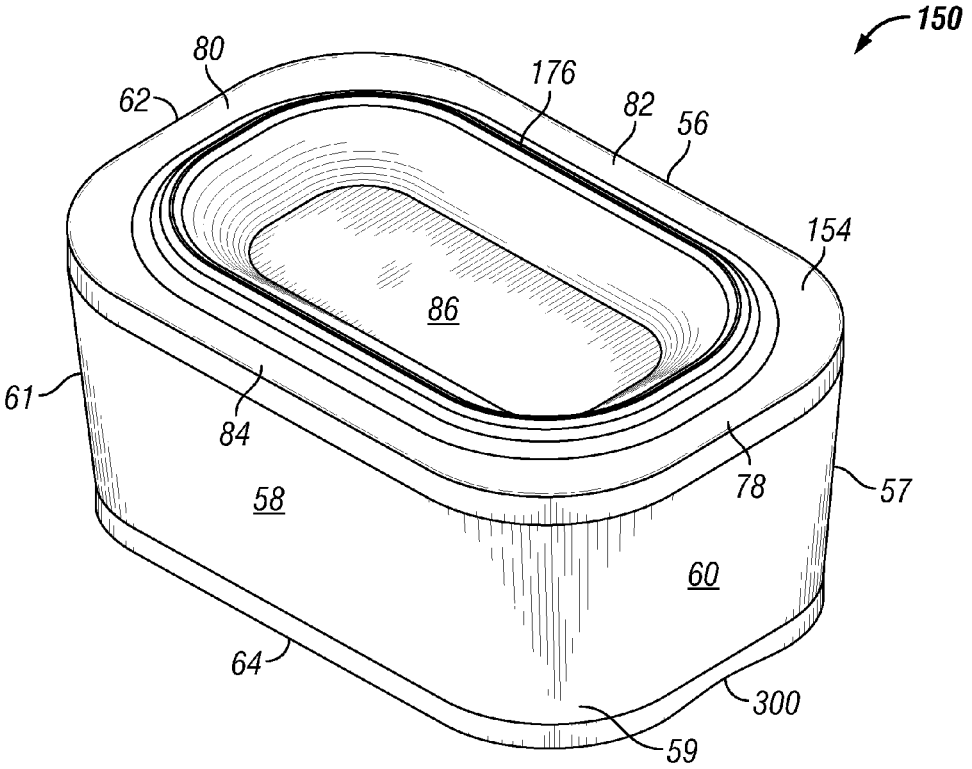
FIG. 13 is a perspective view of another specific embodiment of a cutting element disclosed herein.
Figure 14:
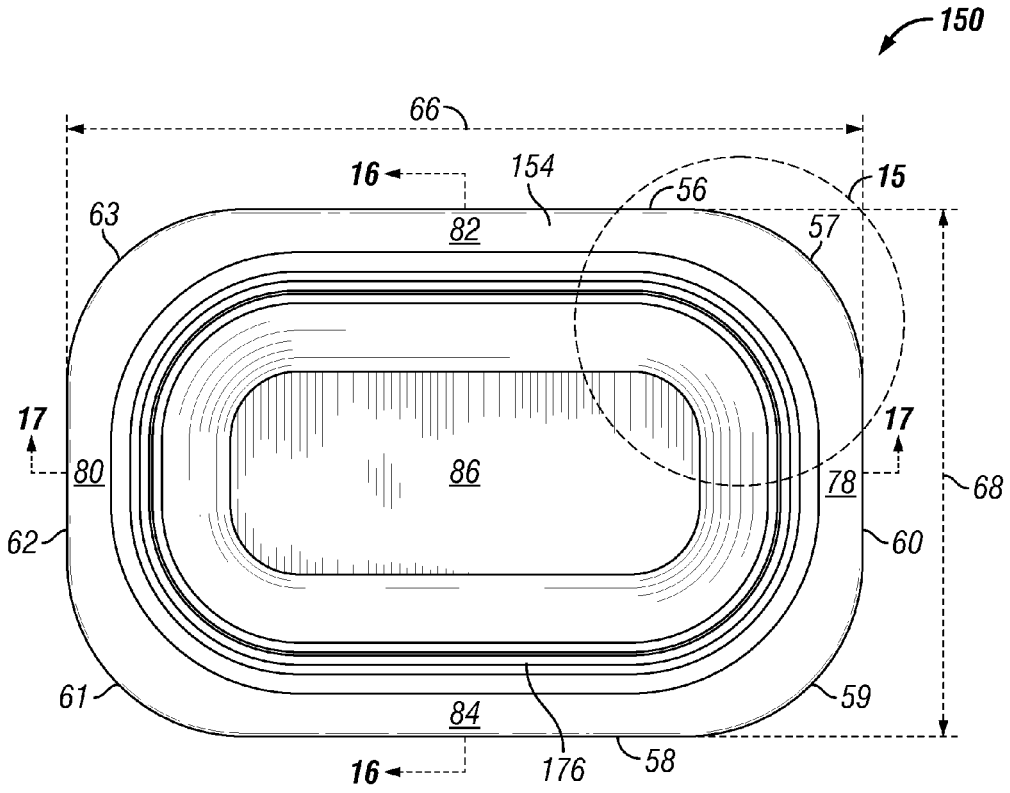
FIG. 14 is a top view of the cutting element shown in FIG. 13.

Referring now to FIGS. 11-12, cutting elements 50, 50' are disposed at a non-parallel angle with respect to each other. In the arrangement of FIG. 11, second longitudinal side surfaces 58 of cutting elements 50, 50' define an acute angle. In this orientation cutting elements 50, 50' can be disposed on the cutting end 24 such that rotation of the tool 10 allows cutting elements 50, 50' to contact the object in the well toward the ends of cutting profiles 76 toward lateral ends 60.

In the arrangement of FIG. 12, first longitudinal side surfaces 56 of cutting elements 50, 50' define an acute angle. In this orientation, cutting elements 50, 50' can be disposed on the cutting end 24 such that rotation of the tool 10 allows cutting elements 50, 50' to contact the object in the well toward the ends of cutting profiles 76 toward lateral ends 62.

Although the embodiment of FIGS. 1-12 is shown as having cutting profile 76 being disposed asymmetrically on top surface 54, it is to be understood that cutting profile 76 can be disposed symmetrically on top surface 54 such as shown in the embodiment of FIGS. 13-23.

Referring now to FIGS. 13-23, cutting element 150 is shown. In the embodiment of FIGS. 13-23, some of the same reference numerals used to describe cutting element 50 are used to describe cutting element 150. In these instances, it is to be understood that the structures so described with respect to the embodiment of FIGS. 13-23 are the same as in the embodiment of FIGS. 1-12. In the embodiment of FIGS. 13-23, cutting element 150 comprises cutting profile 176 disposed symmetrically on top surface 154. Thus, each of portions or areas of top surface 154 disposed around the outside or circumference of cutting profile 176, e.g., cutting surface portions 78, 80, 82, 84 is equal to the other such portions. Each of cutting surface portions 78, 80, 82, 84 can have distances 79, 81, 83, and 85 in the range from 0.010 inches to 0.120 inches. In one particular embodiment, each of distances 79, 81, 83, and 85 are 0.030 inches.

Figure 15:
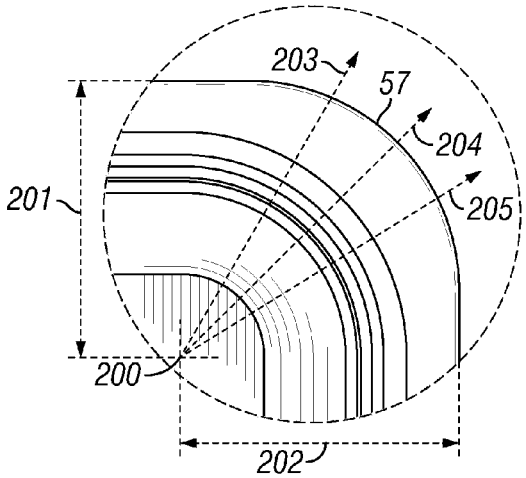
FIG. 15 is an enlarged view of the portion of the cutting element encircled along line 15 in FIG. 14.

Referring to FIG. 15, radial surface 57 comprises radii of curvature 203, 204, 205 as measured from center 200. Center 200 is determined by the perpendicular intersection of distances 201, 202 as measured from first longitudinal side surface 56 and first lateral side surface 60, where distance 201 equals 202. Distances 201, 202 can be in the range from 0.100 inches to 0.350 inches and radii of curvatures 203, 204, 205 can be in the range from 0.100 inches to 0.300 inches. In one particular embodiment, distances 201, 202 are each 0.165 inches, radii of curvature 203, 205 are each 0.135 inches and radius of curvature 204 is 0.125 inches.

In the embodiment of FIGS. 13-23, each of radial surfaces 59, 61, 63 are identical to radial surface 57 It is to be understood, however, that one or more of radial surfaces 59, 61, or 63 may be different from radial surface 57, as well as different from each other.

Figure 16:
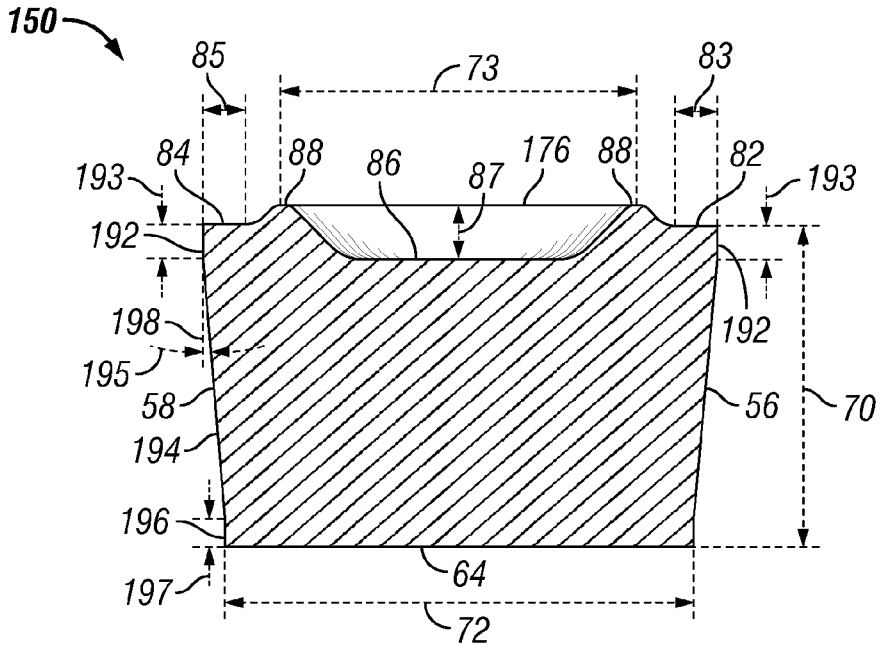
FIG. 16 is a cross-sectional view of the cutting element of FIG. 14 taken along line 16-16.
Figure 17:
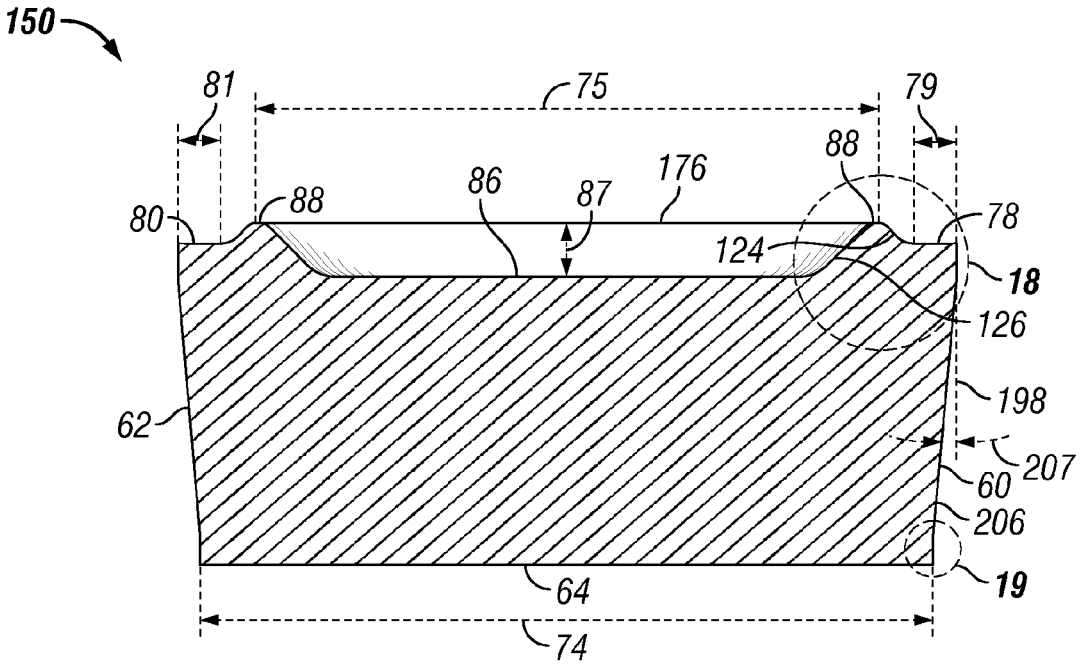
FIG. 17 is a cross-sectional view of the cutting element of FIG. 14 taken along line 17-17.
Figure 18:
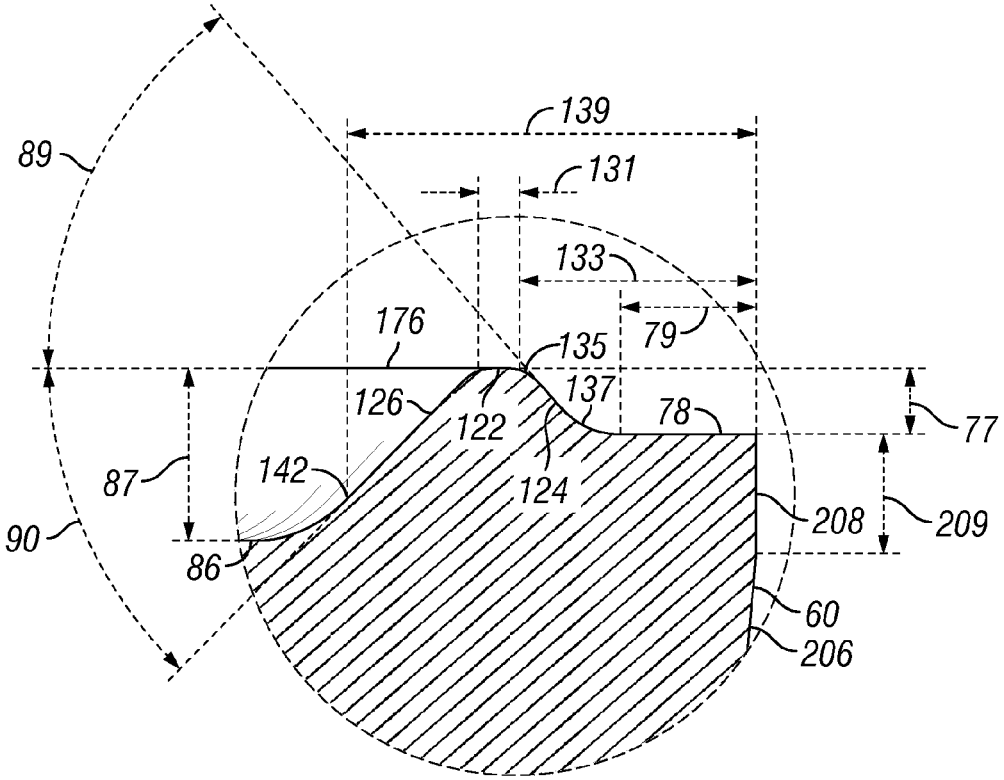
FIG. 18 is an enlarged cross-sectional view of the portion of the cutting element encircled along line 18 in FIG. 17.
Figure 19:
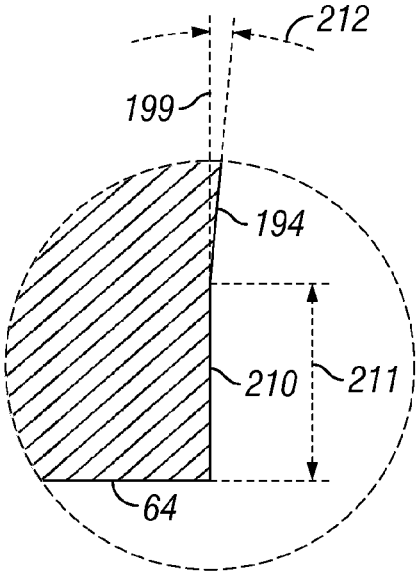
FIG. 19 is an enlarged cross-sectional view of the portion of the cutting element encircled along line 19 in FIG. 17.

Referring now to FIGS. 16-18, a cross-section view of second longitudinal side surface 58 shows that second longitudinal side surface 58 comprises bevel portion 194 disposed at angle 195 relative to axis 198. Axis 198 is disposed perpendicular to top surface 154. Angle 195 can be in the range from 3 degrees to 12 degrees. In a specific embodiment angle 195 is 5 degrees.

In addition, cross-section view of second longitudinal side surface 58 shows that second longitudinal side surface 58 includes upper portion 192 that is parallel to axis 198 and lower portion 196 that is parallel to axis 198. Length 193 of upper portion 192 can be any distance/measurement desired or necessary to facilitate placement of cutting element 150 on cutting end 24 of a downhole cutting tool (FIG. 1). For example, length 193 can be in the range from 0.010 inches to 0.035 inches. In a specific embodiment, length 193 of upper portion 192 is 0.025 inches.

Length 197 of lower portion 196 can be any distance/measurement desired or necessary to facilitate placement of cutting element 150 on cutting end 24 of a downhole cutting tool. For example, length 197 can be in the range from 0.001 inches to 0.040 inches. In a specific embodiment, length 197 of lower portion 196 is 0.020 inches.

As also shown in FIGS. 16-17, cutting profile 176 includes width 73 (FIG. 16) and length 75 (FIG. 17). Width 73 is measured as the distance between the uppermost points of cutting edge 88 along a line perpendicular to cutting edge 88 extending across recess 86. Length 75 is measured as the distance between the uppermost points of cutting edge 88 along a line perpendicular to cutting edge 88 extending across recess 86. Width 73 can be in the range from 0.050 inches to 0.60 inches and length 75 can be in the range from 0.050 inches to 1.0 inch. In one particular embodiment, width 73 is 0.260 inches and length 75 is 0.448 inches.

Referring now to FIG. 18, the uppermost point of cutting edge 88 is disposed above cutting surface 154 at height 77 (FIG. 18). Height 77 can be in the range from 0.005 inches to about 40% of height 70. In one particular embodiment, height is 0.015 inches.

As shown in FIG. 18, cutting edge 88 comprises upper edge surface 122 that has width 131 such that the outer most point of width 131, i.e., the point of width 131 closest to first lateral side surface 60, is disposed at a distance 133 from first lateral side surface 60. Width 131 can be in the range from 0.002 inches to 0.020 inches. In one particular embodiment, width 131 is 0.010 inches. Distance 133 can be in the range from 0.200 inches to 0.010 inches. In one particular embodiment, distance 133 is 0.053 inches.

The intersection of upper edge surface 122 of cutting edge 88 with outermost edge surface 124 of cutting edge 88, i.e., the side of cutting edge 88 connecting to cutting surface portion 78, provides radius of curvature 135. The point at which upper edge surface 122 of cutting edge 88 intersects with outermost edge surface 124 of cutting edge 88 is a transition point. The intersection between the cutting surface portion 78 with outermost edge surface 124 of cutting edge 88 provides radius of curvature 137. Radii of curvature 135, 137 can be can be in the range from 0.003 inches to 0.040 inches. In one particular embodiment radius of curvature 135 is 0.010 inches and radius of curvature 137 is 0.020 inches.

As also shown in FIG. 18, the intersection between cutting recess 89 and innermost edge surface 126 of cutting edge 88, i.e., the side of cutting edge 88 connecting to cutting recess 86, provides radius of curvature 142. Radius of curvature 142 can be can be in the range from 0.010 inches to 0.060 inches. In one particular embodiment radius of curvature 142 is 0.030 inches.

Distance 139 is measured between the point at which innermost edge surface 126 of cutting edge 88 begins to transition into radius of curvature 142 and first lateral side surface 60.

Distance 139 can be in the range from 0.050 inches to 0.250 inches. In one particular embodiment, distance 139 is 0.1030 inches.

As illustrated in FIGS. 17-18, a cross-section view of first lateral side surface 60 shows that first lateral side surface 60 comprises bevel portion 206 disposed at angle 207 (FIG. 17) relative to axis 199. Axis 199 is disposed perpendicular to bottom surface 64. Angle 207 can be in the range from 3 degrees to 12 degrees. In a specific embodiment angle 207 is 5 degrees.

In addition, cross-section view of first lateral side surface 60 shows that first lateral side surface 60 includes upper portion 208 (FIG. 17) that is parallel to axis 198 and lower portion 210 (FIG. 19) that is parallel to axis 198. Length 209 of upper portion 208 can be any distance/measurement desired or necessary to facilitate placement of cutting element 150 on cutting end 24 of a downhole cutting tool (FIG. 1). For example, length 209 can be in the range from 0.010 inches to 0.035 inches. In a specific embodiment, length 209 of upper portion 208 is 0.025 inches.

Length 211 of lower portion 210 can be any distance/measurement desired or necessary to facilitate placement of cutting element 150 on cutting end 24 of a downhole cutting tool (FIG. 1). For example, length 211 can be in the range from 0.001 inches to 0.040 inches. In a specific embodiment, length 211 of lower portion 210 is 0.020 inches. Lower portion 210 is disposed relative to bevel portion 194 at angle 212 (FIG. 19) relative to axis 198. Angle 212 can be in the range from 3 degrees to 12 degrees. In a specific embodiment angle 212 is 5 degrees.

Although not shown in detail, it is to be understood that in the embodiment shown in FIGS. 13-23, the cross-section of second lateral side surface 62 comprises the same cross-section as that of first lateral side surface 60. In other words, the cross-section of second lateral side surface 62 has the same beveled portions, parallel portions, and angles as first lateral side surface 60. It is also to be understood that these cross-sections are not required to be identical.

It is to be understood that in the embodiment shown in FIGS. 13-23, the cross-section of second longitudinal side surface 58 comprises the same cross-section as that of first longitudinal side surface 56. In other words, the cross-section of first longitudinal side surface 56 has the same beveled portions, parallel portions, and angles as second longitudinal side surface 58. It is also to be understood that these cross-sections are not required to be identical.

Further, it is to be understood that, in the embodiment of FIGS. 13-23, the cross-section of first and second longitudinal side surfaces 56, 58 comprise the same cross-section as that of first and second lateral side surfaces 60, 62. It is also to be understood, however, that the cross-sections of first and second longitudinal side surfaces 56, 58 are not required to be the same as the cross-sections of first and second lateral side surfaces 60, 62 and that that none of the cross-sections of first and second longitudinal side surface 56, 58 or first or second lateral side surfaces 60, 62 are required to identical to each other.

Figure 20:
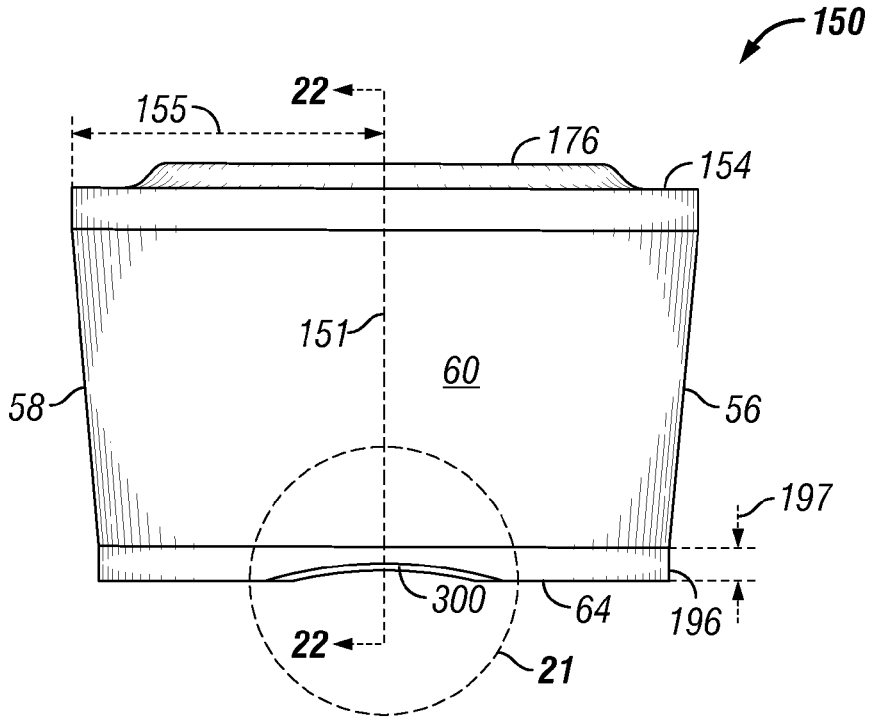
FIG. 20 is a side view of the embodiment of the cutting element of FIG. 14.
Figure 21:
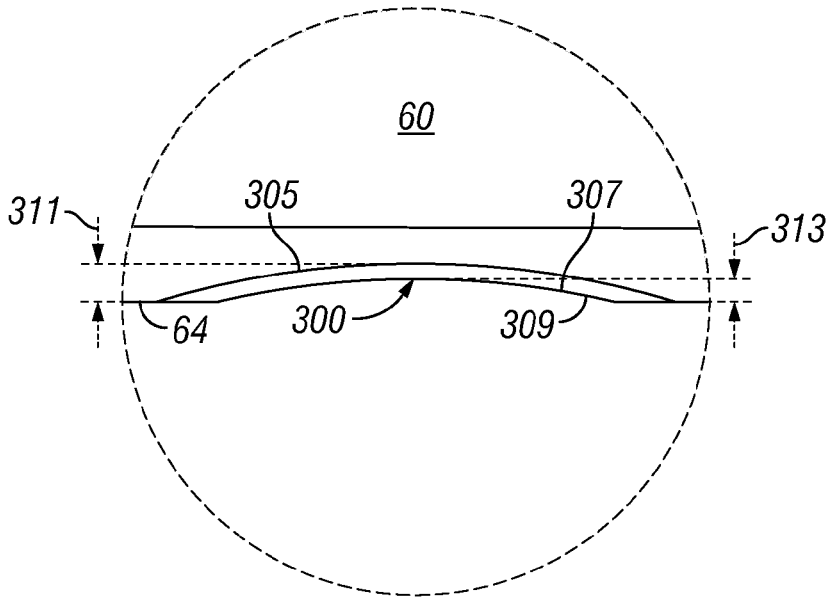
FIG. 21 is an enlarged cross-sectional view of the portion of the cutting element encircled along line 21 in FIG. 20.
Figure 22:
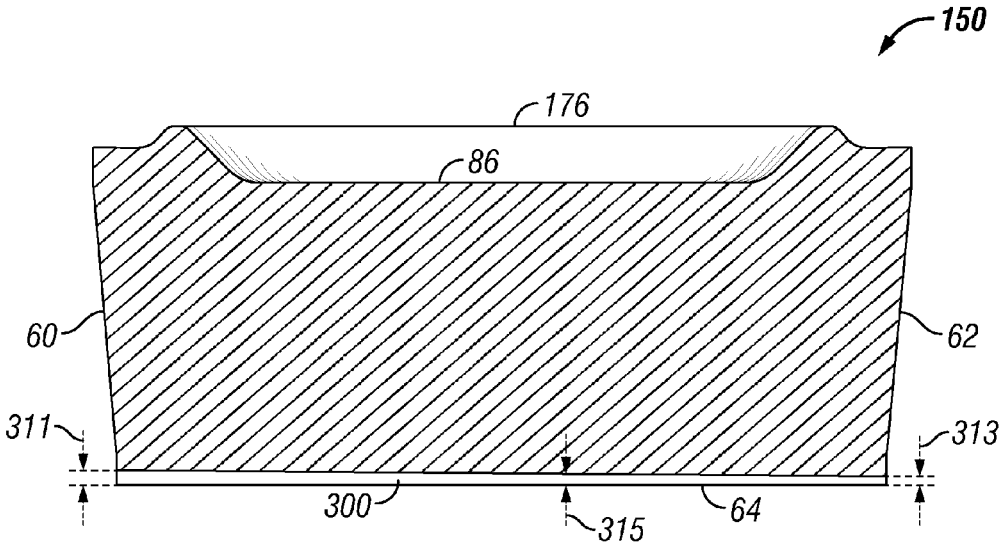
FIG. 22 is a cross-sectional view of the cutting element of FIG. 20 taken along line 22-22.

Referring now to FIGS. 20-22, bottom surface 64 of cutting element 150 comprises recess 300. Recess 300 is shown disposed continuously between first and second lateral side surfaces 60, 62, however, it is to be understood that recess 300 can be omitted from cutting element 150 in its entirety, or can be disposed such that it does not reach one or both of first or second lateral side surfaces 60, 62, or such that recess 300 is not a single continuous recess.

Figure 23:
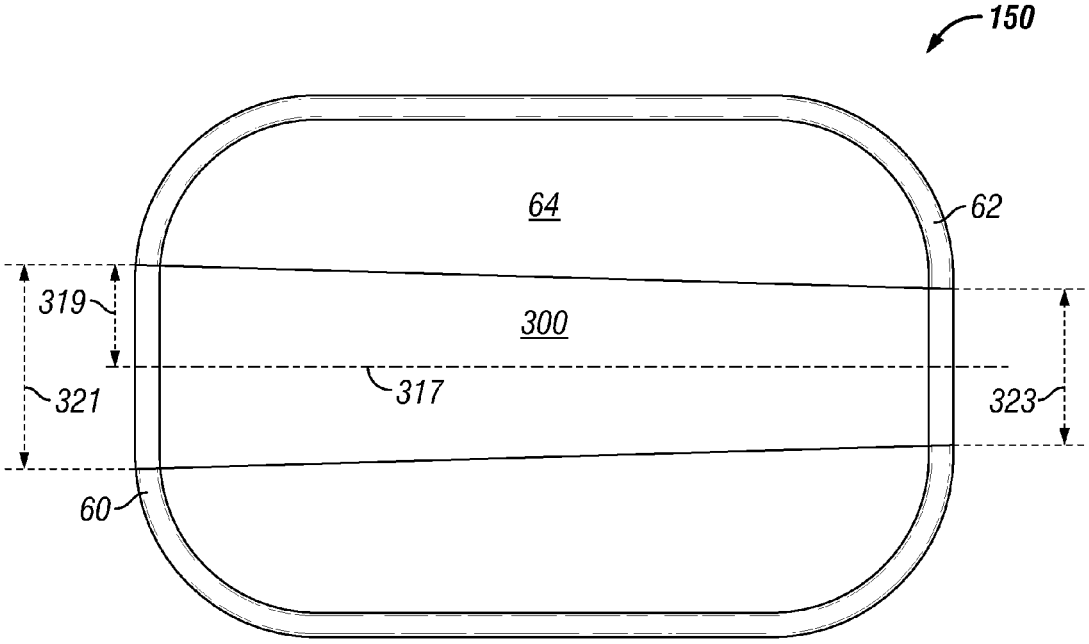
FIG. 23 is a bottom view of the cutting element shown in FIG. 14.

As shown in FIGS. 21-23, recess 300 comprises radii of curvature 305, 307, and 309, each of which can be in the range from 0.010 inches to 0.500 inches. In one specific embodiment, radii of curvature 305, 307 are 0.250 inches and radius of curvature 309 is 0.060 inches.

In addition, in the embodiment of FIGS. 13-23, recess 300 comprises a varying height that is highest at first lateral side surface 60 (height 311) and shortest at second lateral side surface 62 (height 313) and a varying width that is widest at first lateral side surface 60 (width 321) and narrowest at second lateral side surface 62 (width 323). Angle 315 (FIG. 22) indicates the slope from height 313 to height 311 as measured at the mid-point along recess 300 between first lateral side surface 60 and second lateral side surface 62. Heights 311, 313 can be in the range from 0.001 inches to 0.020 inches and angle 315 can be in the range from 0.2 degrees to 0.6 degrees. In one specific embodiment, height 311 is 0.005 inches, height 313 is 0.009 inches and angle 315 is 0.425 degrees. In the embodiment of FIGS. 13-23, width 321 is greater than width 323. Axis 317 defines angle 319 indicating the slope of recess 300 from second lateral side surface 62 to first lateral side surface 60. Width 321 is greater than width 323. Angle 319 can be in the range from 0.5 degrees to 4 degrees. In one particular embodiment, angle 319 is 1.808 degrees.

FIG. 22 is the cross-sectional view of cutting element 150 taken along line 22-22 of FIG. 20 which cuts cutting element 150 in half longitudinally along axis 151. Distance 155 is measured between axis 151 and second longitudinal side surface 58. Distance 155 can be in the range from 0.050 inches to 0.400 inches. In one particular embodiment, distance 155 is 0.188 inches.

In one particular embodiment of cutting element 150 of FIGS. 13-23, length 66 is 0.563 inches, width 68 is 0.375 inches, length 74 is 0.530 inches, width 72 is 0.342 inches, height 70 is 0.235 inches, radius of curvature of 203, 204 and 205 of each of radial surfaces 57, 59, 61, 63 based on distances 201, 202 being 0.165 inches are each 0.135, 0.125, and 0.049 inches respectively, distances 79, 81, 83, 85 of cutting surface portions 78, 80, 82, 84, each are 0.030 inches, width 73 is 0.260 inches, length 75 is 0.448 inches, length 193 of upper portion 192 is 0.025 inches, angle 195 is 5 degrees, length 197 of lower portion 196 is 0.020 inches, height 77 is 0.015, width 131 is 0.010 inches, distance 133 is 0.053 inches, distance 139 is 0.103 inches, radius of curvature 135 is 0.010 inches, radius of curvature 137 is 0.020 inches, radius of curvature 142 is 0.300 inches, angle 89 is 45 degrees, angle 90 is 45 degrees, depth 87 is 0.040 inches, length 209 of upper portion 208 is 0.025 inches, angle 207 is 5 degrees, angle 212 is 5 degrees, length 211 of lower portion 210 is 0.020 inches, and distance 155 is 0.188 inches. In one particular embodiment that includes recess 300, radius of curvature 305 is 0.250 inches, radius of curvature 307 is 0.250 inches, radius of curvature 309 is 0.060 inches, height 311 is 0.009 inches, height 313 is 0.005 inches, angle 315 is 0.425 degrees, and angle 319 is 1.808 degrees.

The cutting elements 50, 150 having cutting profiles 76, 176, respectively, comprising one or more of the measurements, dimensions, radii of curvature, and/or angles described herein with respect to cutting edge 88 facilitate cutting edge 88 being sharpened by the object during cutting of the object. In addition, asymmetrical placement of cutting profile 76, 176 on cutting elements 50, 150, respectively, facilitates placement of cutting elements 50, 150 on a cutting tool so that the portion of the object disposed below the center point of the cutting tool can be cut. Thus, cutting elements 50, 150 can be sharpened during cutting and cutting elements 50 having an asymmetrically disposed cutting profile can be used to cut the portion of the object that is disposed directly below the center point of the cutting tool.

It is to be understood that the invention is not limited to the exact details of construction, operation, exact materials, or embodiments shown and described, as modifications and equivalents will be apparent to one skilled in the art. For example, the cutting elements are shown in FIG. 1 as being used on a mill blade, however, the cutting elements may be included on any type of downhole cutting tool such as drill bits and non-blade mills and may be included directly on the face of the cutting end of the tool. Moreover, the angles of the bevel portions of the longitudinal and lateral side surfaces of the cutting elements can be modified as desired or necessary to facilitate placement of the cutting elements on the face or other structure carrying the cutting elements on the cutting end of the downhole cutting tool or to facilitate cutting the object in the wellbore. Likewise, the shapes of the cutting elements can be modified as desired or necessary to facilitate placement of the cutting elements on the face or other structure carrying the cutting elements on the cutting end of the downhole cutting tool. And, the lengths, widths, and heights of the longitudinal and lateral side surfaces can also be modified as desired or necessary to facilitate placement of the cutting elements on the face or other structure carrying the cutting elements on the cutting end of the downhole cutting tool or to facilitate cutting the object in the wellbore. In addition, the height does not need to be consistent or constant across either the length or width of the top surface or the length or width of the bottom surface. Nor is there any requirement that the cutting elements include any radial surfaces, or that if two or more radial surfaces are present, or that any one radius of curvature is equal to any other radius of curvature.

Although at least one of the ranges of measurements, distances, radii of curvature, or angles of cutting edge 88 are important to the self-sharpening of the cutting edge during cutting of an object, it is to be understood that not all of the ranges of measurements, distances, radii of curvature, or angles are required for the cutting elements to provide the self-sharpening function. Further, where the cutting profile is not self-sharpening, the cutting profile can be modified as desired or necessary to facilitate cutting the object such as for placement on the center point of a cutting tool so that the portion of the object disposed under the center point can be cut. Moreover, the size and shape of the cutting surface portions on the top surface of the cutting elements can be modified as desired or necessary to facilitate placement of the cutting elements on the face or other structure carrying the cutting elements on the cutting end of the downhole cutting tool, or to facilitate cutting the object. In addition, although the cutting elements are shown in FIG. 1 as being disposed perpendicular to the blades, i.e., at an angle of 90 degrees relative to the blade, one or more of the cutting elements may be tilted downwardly or upwardly at an angle other than 90 degrees relative to the blades. Therefore, it is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims.

What is claimed is:

1. A cutting element for cutting an object, the cutting element comprising:

a body comprising a top surface, a bottom surface disposed opposite the top surface, a first longitudinal side surface, a second longitudinal side surface disposed opposite the first longitudinal side surface, a first lateral side surface, a second lateral side surface disposed opposite the first lateral side surface;

said lateral and longitudinal side surfaces defining a periphery of said top surface;

a cutting profile, the cutting profile comprising a cutting edge, the cutting edge comprising an upper edge surface, an outermost edge surface, an innermost edge surface, a height determined by the upper edge surface and the top surface, the outermost edge surface spaced from said periphery of said top surface, said upper edge surface and innermost and outermost edge surfaces defining an enclosed recess on said top surface, said top surface extending between said outermost edge surface and said periphery.

2. The cutting element of claim 1, wherein the cutting profile is disposed asymmetrically along the top surface;

the first angle being in the range from about 15 degrees to about 75 degrees and the second angle being in the range from about 15 degrees to about 75 degrees.

3. The cutting element of claim 1, wherein the first angle is about 45 degrees and the second angle is about 45 degrees.

4. The cutting element of claim 3, wherein the upper edge surface comprises an upper edge surface width, the upper edge surface width being in the range from about 0.002 inches to about 0.020 inches and wherein the height is in the range from about 0.005 inches to about 40% of a cutting element height, the cutting element height being determined as a distance measured from the top surface to the bottom surface.

5. The cutting element of claim 4, wherein the cutting profile comprises a cutting profile width and a cutting profile length, the cutting profile width being in the range from about 0.050 inches to about 0.600 inches, and the cutting profile length being in the range from about 0.050 inches to about 1.0 inch.

6. The cutting element of claim 5, wherein said recess comprising a recess depth at least 0.005 inches below the top surface and not exceeding 60% of the height between the top surface and the bottom surface of the cutter, and the innermost edge surface of the cutting edge intersects with the recess at a first radius of curvature, the first radius of curvature being in the range from about 0.010 inches to about 0.060 inches.

7. The cutting element of claim 6, wherein the upper edge surface of the cutting edge intersects with the outermost edge surface of the cutting element at a transition point that is disposed at a distance from the first lateral side surface, the distance being in the range from about 0.002 inches to about 0.020 inches.

8. The cutting element of claim 7, wherein the outermost edge surface of the cutting edge intersects with the top surface at a second radius of curvature, the second radius of curvature being in the range from about 0.003 inches to about 0.040 inches.

9. The cutting element of claim 8, wherein the outermost edge surface of the cutting edge intersects with the upper edge surface of the cutting edge at a third radius of curvature, the third radius of curvature being in the range from about 0.003 inches to about 0.040 inches.

10. The cutting element of claim 9, wherein the height of the cutting edge is about 0.015 inches, the upper edge surface width is about 0.010 inches, the cutting profile width is about 0.260 inches, the cutting profile length is about 0.448 inches, said recess depth is about 0.040 inches, the first radius of curvature is 0.030 inches, the distance of the transition point is 0.053 inches, the second radius of curvature is 0.020 inches, and the third radius of curvature is 0.010 inches.

11. The cutting element of claim 1, further comprising a recess longitudinally disposed in the bottom surface.

12. The cutting element of claim 11, wherein the recess intersects the first lateral side surface and the second lateral side surface.

13. A cutting element for cutting an object, the cutting element comprising:

a body comprising a top surface, a bottom surface disposed opposite the top surface, a first longitudinal side surface, a second longitudinal side surface disposed opposite the first longitudinal side surface, a first lateral side surface, a second lateral side surface disposed opposite the first lateral side surface; and a cutting profile, the cutting profile comprising a cutting edge, the cutting edge comprising an upper edge surface, an outermost edge surface, an innermost edge surface, a height determined by the upper edge surface and the top surface, the outermost edge surface being disposed at a first angle relative to the upper edge surface and the innermost edge surface being disposed at a second angle relative to the upper edge surface, the first angle being in the range from about 15 degrees to about 75 degrees and the second angle being in the range from about 15 degrees to about 75 degrees;

a recess longitudinally disposed in the bottom surface;

the recess intersects the first lateral side surface and the second lateral side surface;

the recess comprises a first recess height disposed at the intersection of the recess with the first lateral side surface and a second recess height disposed at the intersection of the recess with the second lateral side surface, the first recess height being greater than the second recess height.

14. The cutting element of claim 13, wherein the recess comprises a first recess width disposed at the intersection of the recess with the first lateral side surface and a second recess width disposed at the intersection of the recess with the second lateral side surface, the first recess width being greater than the second recess width.

15. The cutting element of claim 14, wherein the first angle is about 45 degrees and the second angle is about 45 degrees.

16. A cutting element for application to a tool for cutting an object, the cutting element comprising:

a planar top surface in a single plane having a periphery and comprising a cutting profile having a cutting edge, the cutting edge having an outermost edge surface being spaced from said top surface periphery to define said top surface therebetween all around said outermost edge surface, said cutting edge shaped to define an enclosed recess with respect to said top surface and to cut an object during which the cutting edge is sharpened by the object during cutting.

17. A method for sharpening a cutting element disposed on a cutting tool during cutting of an object, the method comprising:

(a) providing a cutting tool having a plurality of cutting elements, at least one of the cutting elements comprising a top surface comprising an outer periphery and a cutting profile, the cutting profile comprising a cutting edge defined by a top edge surface and innermost and outermost edge surfaces extending to said top edge surface in a manner to define an enclosed recess with respect to said top surface, said outermost edge surfaces being spaced apart from said outer periphery to define said top surface and the cutting edge being shaped to cut an object during which the cutting edge is sharpened by the cutting of the object;

(b) contacting one or more of the cutting elements with an object to be cut; and (c) rotating the cutting tool to cut the object with one or more of the cutting elements, causing at least one of the one or more cutting elements to be sharpened as the one or more cutting elements cuts the object.

18. A method for sharpening a cutting element disposed on a cutting tool during cutting of an object, the method comprising:

(a) providing a cutting tool having a plurality of cutting elements, at least one of the cutting elements comprising a top surface comprising a cutting profile, the cutting profile comprising a cutting edge defined by a top edge surface and innermost and outermost edge surfaces extending to said top edge surface in a manner to define an enclosed recess with respect to said top surface, the cutting edge being shaped to cut an object during which the cutting edge is sharpened by the cutting of the object;

(b) contacting one or more of the cutting elements with an object to be cut; and (c) rotating the cutting tool to cut the object with one or more of the cutting elements, causing at least one of the one or more cutting elements to be sharpened as the one or more cutting elements cuts the object;

said cutting edge comprising an upper edge surface, an outermost edge surface, an innermost edge surface, a height determined by the upper edge surface and the top surface, the outermost edge surface being disposed at a first angle relative to the upper edge surface and the innermost edge surface being disposed at a second angle relative to the upper edge surface, the first angle being in the range from about 15 degrees to about 75 degrees and the second angle being in the range from about 15 degrees to about 75 degrees.

19. The method of claim 18, wherein the first angle is about 45 degrees and the second angle is about 45 degrees.

20. A method for cutting the center point of an object, the method comprising:

(a) providing a cutting tool having a plurality of cutting elements, said cutting elements comprising a top surface comprising a cutting profile disposed asymmetrically to provide a cutting surface portion disposed about said cutting profile, said cutting profile defines an enclosed shape for a recess with respect to said top surface;

(b) disposing a first cutting element and a second cutting element at the center of a cutting tool, the cutting profile of the first cutting element being disposed facing the cutting surface portion of the second cutting profile and the cutting profile of the second cutting element being disposed facing the cutting surface portion of the first cutting element;

(c) contacting at least one of the first or second cutting elements with an object to be cut; and (d) rotating the cutting tool to cut the object with at least one of the first or second cutting elements, causing the said center point of the object to be cut by at least one of the first or second cutting elements.

21. A cutting element comprising:

a planar top surface in a single plane and a bottom surface, said surfaces separated by lateral surfaces;

said top surface having a shaped projection thereon that defines a recess therein and said projection is an all around spaced projection from a periphery of said top surface, said periphery defined at the intersection of said top and lateral surfaces;

said spaced projection providing strength to said periphery to allow continued cutting as portions of said periphery chip off bringing said periphery toward said projection during cutting.

* * * * *